US007332836B2

(12) United States Patent
Mista

(10) Patent No.: US 7,332,836 B2
(45) Date of Patent: Feb. 19, 2008

(54) GUIDE BAR DRIVE IN A KNITTING MACHINE

(75) Inventor: Kresimir Mista, Heusenstamm (DE)

(73) Assignee: Karl Mayer Testilmaschinenfabrik GmbH, Obertshausen (DE)

( * ) Notice: Subject to any disclaimer, the term of this patent is extended or adjusted under 35 U.S.C. 154(b) by 206 days.

(21) Appl. No.: 11/115,316

(22) Filed: Apr. 27, 2005

(65) Prior Publication Data

US 2005/0284187 A1 Dec. 29, 2005

(30) Foreign Application Priority Data

Jun. 29, 2004 (DE) ..... 10 2004 031 268

(51) Int. Cl.
*H02K 41/00* (2006.01)
*D04B 7/00* (2006.01)

(52) U.S. Cl. ..... 310/12; 66/207; 66/125 R; 310/15; 310/16

(58) Field of Classification Search ..... 310/12, 310/15; 66/64, 207, 125 R
See application file for complete search history.

(56) References Cited

U.S. PATENT DOCUMENTS

| | | | | |
|---|---|---|---|---|
| 2,625,023 | A * | 1/1953 | Bellini | 66/207 |
| 2,775,881 | A * | 1/1957 | Held | 66/207 |
| 4,151,447 | A * | 4/1979 | von der Heide et al. | 318/135 |
| 4,776,185 | A * | 10/1988 | Roth | 66/207 |
| 5,067,332 | A * | 11/1991 | Roth | 66/207 |
| 5,111,672 | A | 5/1992 | Gille et al. | |
| 5,709,108 | A * | 1/1998 | Ono et al. | 66/205 |
| 5,873,267 | A * | 2/1999 | Otobe et al. | 66/204 |
| 6,050,111 | A * | 4/2000 | Nosaka et al. | 66/207 |
| 6,182,476 | B1 * | 2/2001 | Frassi et al. | 66/207 |
| 6,472,779 | B2 * | 10/2002 | Hwang et al. | 310/12 |
| 2004/0261464 | A1 * | 12/2004 | Mista | 66/125 R |

FOREIGN PATENT DOCUMENTS

| | | |
|---|---|---|
| DE | 3932184 | 1/1991 |
| DE | 4217357 | 12/1993 |
| DE | 29713979 | 11/1997 |
| DE | 10026983 | 12/2001 |
| EP | 0921224 | 6/1999 |

* cited by examiner

*Primary Examiner*—Burton Mullins
(74) *Attorney, Agent, or Firm*—Greenblum & Bernstein, P.L.C.

(57) ABSTRACT

Guide bar drive in a knitting machine and method of driving guide bar. The drive includes a linear motor composed of a stator and a rotor, in which the linear motor is greater in height than width. The stator has a length in a longitudinal direction and includes at least one narrow side, and the rotor is structured and arranged in the stator for translational movement in the longitudinal direction. A guide rod is positioned adjacent the at least one narrow side and extending in the longitudinal direction to support the rotor. The instant abstract is neither intended to define the invention disclosed in this specification nor intended to limit the scope of the invention in any way.

19 Claims, 2 Drawing Sheets

GUIDE BAR DRIVE IN A KNITTING MACHINE

CROSS-REFERENCE TO RELATED APPLICATIONS

The present application claims priority under 35 U.S.C. §119 of German Patent Application No. 10 2004 031 268.0-26, filed on Jun. 29, 2004, the disclosure of which is expressly incorporated by reference herein in its entirety.

BACKGROUND OF THE INVENTION

1. Field of the Invention

The invention relates to a guide bar drive in a knitting machine with a linear motor that has a stator and a rotor (moving coil) which can be moved in a translational manner in the stator in the longitudinal direction.

2. Discussion of Background Information

The guide bars or guide rails of a knitting machine have to be driven at least in the longitudinal direction for the loop formation of a textile knitted fabric. Furthermore, in a work cycle the guide bars are often also moved crosswise to the longitudinal direction, as a rule swiveled. Mechanical gearings were used in the past for the movement in the longitudinal direction. A typical gearing thereby features a cam plate that interacts with a push rod and moves the guide bar to and fro in a predetermined manner. However, only cam plates with a limited diameter, and thus with a limited circumference, can be used. The pattern repeat is thus limited. Moreover, a different cam plate is needed for each pattern. For a pattern change, the knitting machine has to be stopped and adapted.

For longer pattern repeats, pattern chains can also be used instead of the cam plates. However, the knitting machine has to be adapted for a pattern change here, too.

Servo-controlled linear gearings have therefore also been used. Linear gearings with servo motors which work in a rotary manner can be used only to a limited extent due to the space conditions in a knitting machine. The gearings, which serve as a converter of a rotary to a linear movement, are subject to wear and require a complex construction because as a rule an oil lubrication and accordingly a housing with an oil seal is necessary.

DE 42 17 357 C2 shows a guide bar drive of the type mentioned at the outset, namely a linear motor that can be connected to the guide rail of a warp knitting machine. The rotor can be moved to and fro in the stator. It is supported in linear guides with axial extensions that are attached on the end faces of the stator. Problems with respect to space requirements also arise with this solution. As long as the drive has to drive only one guide bar, there are no conflicts. However, when several guide bars are used, they have to be arranged as closely adjacent to one another as possible, so that the guides can be guided through needle gaps between needles if possible at the same time or with only a slight delay. If the guide bars are very close together, then accordingly only little space is available for the linear motor.

SUMMARY OF THE INVENTION

The instant invention creates favorable space conditions for the connection of a guide bar to its drive.

According to the invention, a guide bar drive of the type mentioned at the outset includes a linear motor higher than it is wide and a rotor (moving coil) supported on a guide rod adjacent to a narrow side of the stator and running in the longitudinal direction.

With this embodiment, the linear motor is initially made "narrow," i.e., it has a smaller dimension in the direction in which several drives have to be arranged next to one another than in a direction perpendicular thereto and perpendicular to the longitudinal direction. The direction in which the linear motors of several guide bars are arranged next to one another is termed the "width direction." The direction that is aligned perpendicular to the width direction and perpendicular to the longitudinal direction is termed the "height direction." Since the linear motor is narrow, several linear motors can easily be arranged next to one another. The term "next to one another" here also covers the arrangement of the linear motors along a curve so that the guide bars driven by the linear motors can align their guides such that they almost meet at one point. The rotor is now supported on a guide rod that is adjacent to a narrow side of the stator and runs in the longitudinal direction. The support of the rotor is thus taken out of the cross section profile of the linear motor and shifted to a point where this is favorable in terms of space. Thus no space is needed in the width direction for the support, but, if anything, a slight enlargement of the dimension in the height direction. However, this is non-critical. Above all, it can be ensured with such an embodiment that the support of the rotor is narrower than the largest extension of the linear motor in the width direction at another point. This makes it easier to arrange several linear motors next to one another in a segment-like manner, as it were, and to arrange the guide bars driven by these linear motors correspondingly closely adjacent to one another.

Preferably the guide rod is supported in flanges that are arranged on both end faces of the stator. The support of the guide rod thus does not require any additional space in the width direction.

Preferably the flanges project beyond the narrow side of the stator. Accordingly, a guide rod embodied in a straight line can be used. The flanges do not require any additional space in the width direction.

In a preferred embodiment it is provided that the guide rod is supported in a rotationally fixed manner and the rotor has a stabilizer with respect to the guide rod. The guide rod thus not only guides the rotor to and fro in the longitudinal direction, it also ensures its positioning within the stator. This makes it possible, e.g., to retain air gaps of a predetermined size, even if certain forces are acting within the linear motor.

Preferably, a guide bar connection is provided on the rotor on the side of the guide rod opposite the stator. This provides favorable force ratios. However, it is also possible to make the guide bar connection even narrower than the widest part of the body of the linear motor so that individual linear motors can be arranged very closely adjacent to one another particularly where it is important, namely in the area of the guide bars or guide rails.

Preferably the guide bar connection has a push rod and a tension cable. In this regard, the tension cable is loaded by a spring, the outer diameter of which is at most as large as the outer diameter of the guide rod. It is thus possible to make the guide bar connection narrower than the rotor in the area of the guide rod. The guide rod has to be surround by a certain material of the rotor so that this material can absorb forces. This is not absolutely essential in the case of the spring. Although it is favorable if it is housed in a tubular casing, this casing does not have to be able to absorb virtually any lateral forces. It is thus possible to further taper the linear motor in the area of the guide bar.

Preferably the push rod has a greater spacing from the guide rod than the tension cable. The push rod can have a still smaller width than the spring. Accordingly, the rotor can be further tapered towards the end at which the guide bar is arranged.

Preferably the rotor is attached to the guide rod and the guide rod can be displaced with respect to the stator. Although in this embodiment the guide rod has to be moved together with the rotor, it is not necessary to provide bearings between the rotor and the guide rod, which bearings permit a movement. This saves construction space in the width direction.

Preferably the rotor is supported on the guide rod via a connection carrier. The rotor can thus be designed virtually exclusively with respect to its electromechanical function. The carrier function is performed by the connection carrier. The rotor needs only to be connected to the connection carrier in a suitable manner. However, this can be done in a manner known per se, e.g., through gluing, screwing or the like.

Preferably the connection carrier has at least one cooling fin and is connected to the rotor in a heat-conducting manner. The rotor of the linear motor and thus the motor itself receives a cooling via the connection carrier, so that a certain power loss can be dissipated.

Preferably the guide rod has a hollow space running in the longitudinal direction. This hollow space has two advantages. On the one hand it saves weight. A guide rod embodied in a solid manner has a substantially greater mass than a guide rod containing a hollow space, without its stability being appreciably increased.

However, it is particularly preferred that the hollow space is connected to a coolant source. A coolant can thus be fed to the rotor through the guide rod.

On its narrow side facing away from the guide rod, the rotor preferably has a lateral sliding guide arrangement with respect to the stator. In operation considerable forces at times can act on the rotor crosswise to the longitudinal direction. Although these transverse forces can be absorbed in part through the rotationally fixed connection of the rotor to the guide rod and the rotationally fixed fastening of the guide rod with respect to the rotor. However, an additional support, as the sliding guide arrangement shows, is favorable here.

Preferably the rotor is embodied as an iron-free rotor. An iron-free rotor has, e.g., a copper bobbin or an arrangement of several copper bobbins which generate a traveling field and are repelled from the permanent magnets located in the stator.

Alternatively or additionally, the rotor can be equipped with permanent magnets. This, too, is a preferred embodiment.

The present invention is directed to a guide bar drive in a knitting machine. The drive includes a linear motor composed of a stator and a rotor, in which the linear motor is greater in height than width. The stator has a length in a longitudinal direction and includes at least one narrow side, and the rotor is structured and arranged in the stator for translational movement in the longitudinal direction. A guide rod is positioned adjacent the at least one narrow side and extending in the longitudinal direction to support the rotor.

According to a feature of the invention, the stator can include end faces, and the drive may further include flanges arranged at both end faces of the stator to support the guide rod. The flanges can project beyond the at least one narrow side.

In accordance with another feature of the instant invention, the guide rod may be supported in a rotationally fixed manner and the rotor may include a stabilizer coupled to the guide rod.

Further, a guide bar connection can be coupled to the rotor on a side of the guide rod opposite the stator. The guide bar connection may include a push rod and a tension cable tightenable by a spring, and an outer diameter of the spring can be at most as large as an outer diameter of the guide rod. The push rod can have a larger spacing from the guide rod than the tension cable.

According to still another feature, the rotor may be coupled to the guide rod and the guide rod can be displaceable with respect to the stator.

A connection carrier can be structured and arranged to support the rotor on the guide rod. The connection carrier may include at least one cooling fin and is attached to the rotor in a heat-conducting manner.

Moreover, the guide rod can include a hollow space running in the longitudinal direction, and the hollow space can be connected to a coolant source.

A lateral sliding guide arrangement may be between the rotor and the stator arranged at an end of the stator opposite the at least one narrow end.

Still further, the rotor can be formed as an iron-free rotor.

Also, at least one of the stator and the rotor can be equipped with permanent magnets.

The instant invention is directed to a method of driving a guide bar in a knitting machine that includes coupling a guide bar to a moving coil of a linear motor, and translationally moving the coil in a longitudinal direction of a stator having at least one narrow side, while the coil is supported adjacent the at least one narrow side.

In accordance with a feature of the invention, the guide bar may be coupled to the moving coil by at least a push rod and a tension cable tightenable by a spring.

The instant invention is directed to a guide bar drive in a knitting machine that includes a linear motor composed of a stator having a length in a longitudinal direction and a narrow side, and a moving coil structured and arranged for translational movement in the longitudinal direction. A support element is coupled to support the moving coil adjacent the narrow side.

According to another feature of the invention, a guide bar may be coupled to support element.

In accordance with still yet another feature of the present invention, the support element can taper from the narrow side in a direction away from the stator.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figures 1, 2:
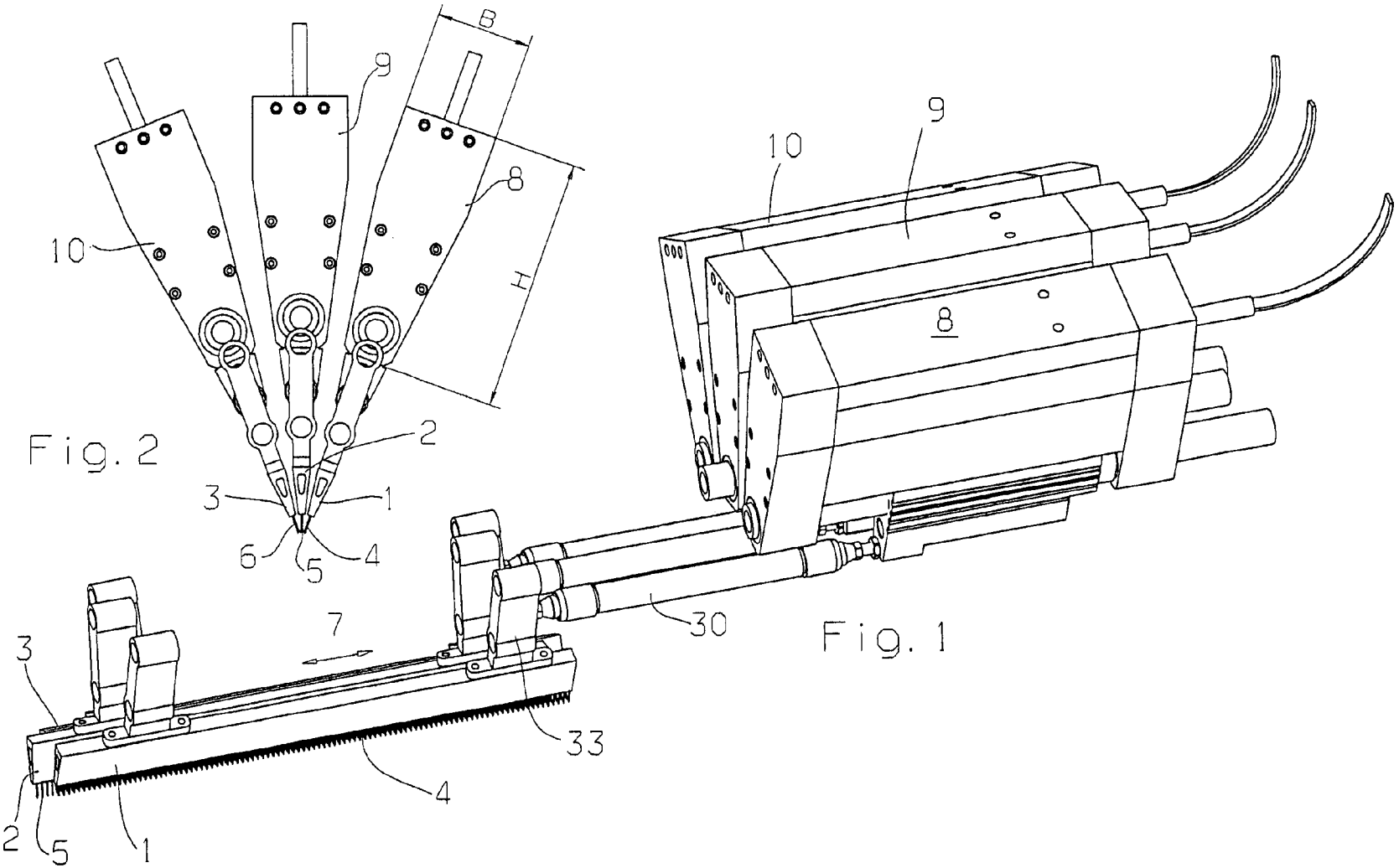
FIG. 1 illustrates an isometric representation of a group of three guide bars with associated drives.
FIG. 2 illustrates a front view of the group depicted in FIG. 1.

FIGS. 1 and 2 show three guide bars 1, 2, 3, which can also be referred to as "guide rails." Guide bar 1-3 has a plurality of guides 4, 5, 6. Guide eyes that guide threads (not shown in further detail) are located at the tip of the guide bars 4-6. The tips of guides 4-6 should thereby be as closely adjacent to one another as possible so that the threads of all guide needles 4-6 can be guided through needle gaps of knitting needles (not shown in further detail) at the same time if possible. To this end, as shown by FIGS. 1 and 2, guide rails 1-3 are arranged, as it were, in a fan-shaped manner. Instead of the three guide bars 1-3 shown, substantially more guide bars can also be used, e.g., up to 20 guide bars.

Figure 3:
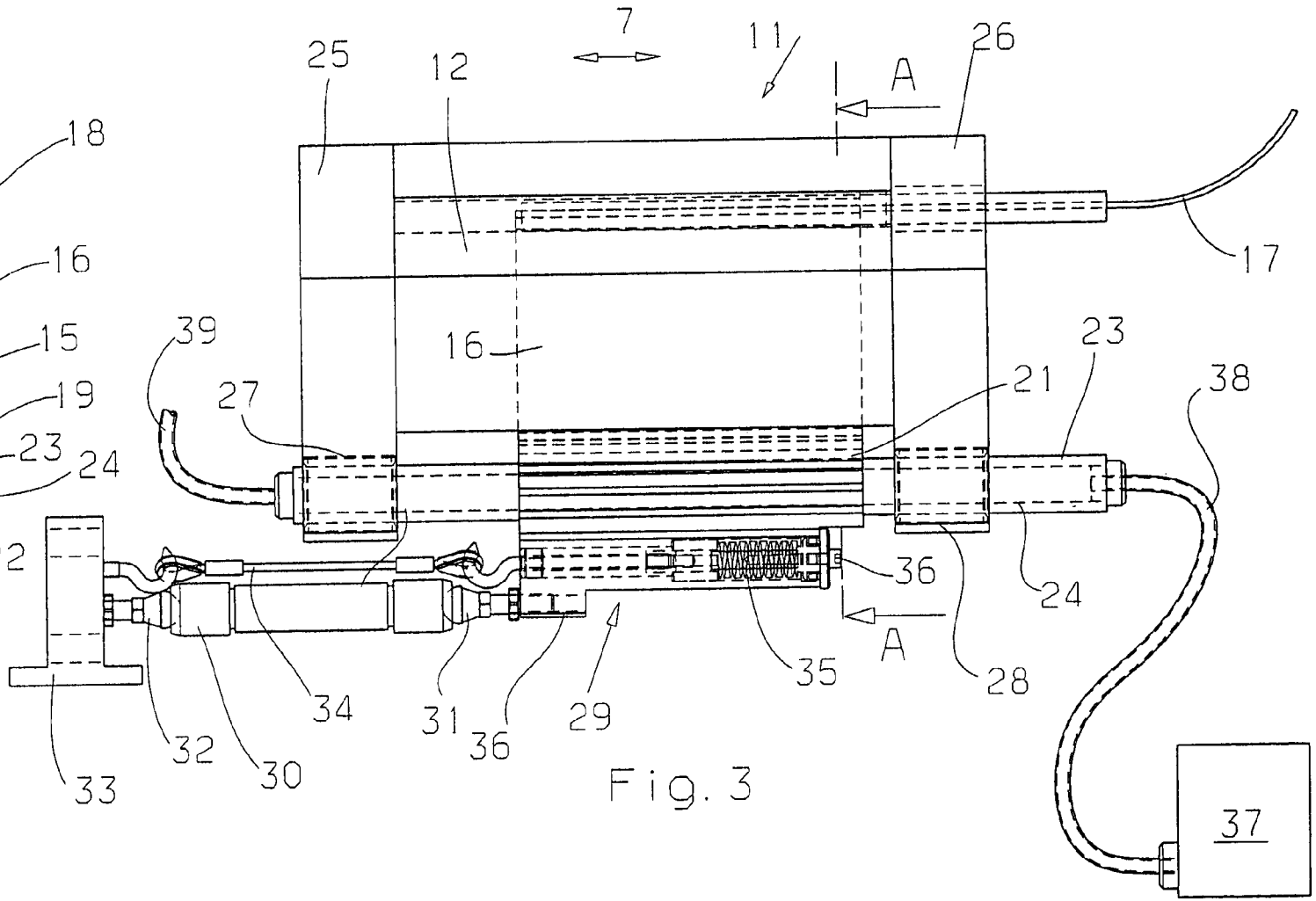
FIG. 3 illustrates a side view of a linear motor with iron-free rotor.
Figure 4:
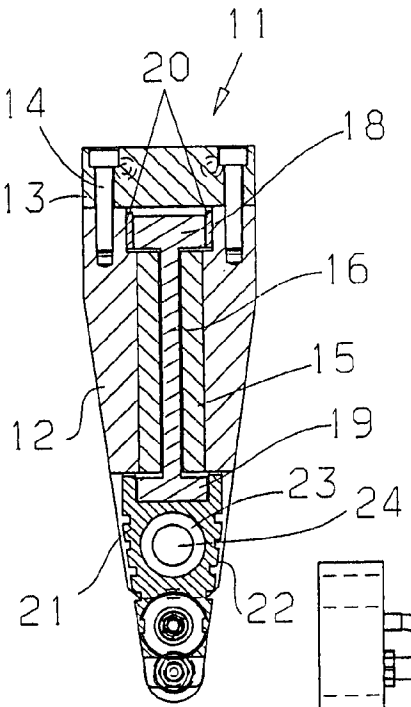
FIG. 4 illustrates a view along section III-III depicted in FIG. 3

It has to be possible to drive individual guide bars 1-3 in the longitudinal direction (in FIG. 2 perpendicular to the drawing plane, in FIG. 1 in the direction of a double arrow 7) independently of one another. To this end, each guide bar 1-3 has a drive 8-10 which can be controlled individually. As can be easily seen from FIG. 2, only limited space is available for each drive. This space is limited above all in the width direction B of each drive 8-10, whereby the available space is still further reduced with increasing proximity to the guide bars 1-3. In contrast, more space is available in the height direction H. For this reason a linear motor 11 shown in FIGS. 3 and 4 is used as drive 8-10, whereby this linear motor 11 can be used in all drives 8-10.

Linear motor 11 has a stator 12 with a cover 13 which is attached to stator 12 via screws 14. Stator 12 is provided with permanent magnets 15. A rotor (moving coil) 16 is arranged in the stator 12, which rotor is embodied as an iron-free rotor. The rotor 16 can have, e.g., a copper winding arrangement laminated in plastic, which winding arrangement is supplied with electric power via an electric cable 17. With a corresponding load of the individual copper windings, e.g., a traveling field is generated which leads to the rotor 16 moving with respect to the stator 12 in the longitudinal direction 7.

On the upper and lower end the rotor 16 respectively features a widening 18, 19, whereby the widenings 18, 19 can accommodate a part of the bobbins.

At the upper end the extension 18 is supported laterally with respect to the stator 12 by sliding guides 20 that form a friction bearing arrangement, i.e., the rotor 16 is prevented from tipping with respect to the stator 12.

At the lower end a connection carrier (stabilizer) 21 is connected to the rotor 16 via the widening 19. The connection carrier 21 can be made, e.g., of aluminum or another material that is a good heat conductor. The connection carrier 21 can be adhered to the rotor 16, e.g., with the aid of a heat-conducting adhesive. The connection carrier 21 has several cooling fins 22.

A guide rod 23, which is hollow, i.e., encloses a hollow space 24 extending in the longitudinal direction, projects through the connection carrier 21. The connection carrier 21 and thus the rotor 16 is fixed on the guide rod 23 in a rotationally fixed manner.

The guide rod 23 in turn is supported in a displaceable manner in two flanges 25, 26 in the longitudinal direction 7. The two flanges 25, 26 are arranged on the two end faces of the stator 12 and project beyond the lower narrow side of the stator 12. There they form guides 27, 28 for the guide rod 23 so that the rotor 16 together with the guide rod 23 can be moved in the longitudinal direction 7 when it is correspondingly excited via the electric lead 17.

The connection carrier 21 tapers conically downwards, i.e., at its widest point it is already narrower than the widest point of the stator 12. At its end facing away from the stator 12, the connection carrier 21 is even narrower.

A guide bar connection 29 is provided under the guide rod 23, i.e., on the side of the guide rod 23 facing away from the stator 12. The guide bar connection 29 first features a push rod 30 that is connected to the guide bar connection 29 via a ball joint 31. Moreover, the push rod 30 is connected to a push rod head 32 that acts on a guide bar carrier 33. On the other hand the guide bar connection 29 is connected to the guide bar carrier 33 via a tension cable 34. To tighten the tension cable 34, the guide bar connection 29 has a spring 35, the preloading of which can be adjusted via a screw 36. The spring 35 thereby features a diameter which is at most as large as the diameter of the guide rod 23. The push rod 30, which has an even smaller diameter, is arranged at the lower end of the linear motor 11, i.e., further away from the guide rod 23 than the tension cable 34 and thus the spring 35. The push rod 30 is also attached only to a projection 36 of the guide bar connection 29. This projection 36 does not go across the entire length of the rotor 16, which means that weight can be saved.

The guide rod 23 is held in the guides 27, 28 in a rotationally fixed manner, so that it additionally secures the rotor 16 against tilting with respect to the stator 12.

The hollow space 24 is connected via a flexible line 38 to a coolant source 37 (shown only in diagrammatic form), so that coolant can flow into the hollow space 24 and the rotor 16 can be cooled by the coolant from the coolant source 37, whenever necessary. The coolant is drained off at the other end via a flexible line 39.

The linear motor 11 can also be embodied in a different way. For example, the rotor 16 can support the permanent magnets if a corresponding bobbin arrangement is embodied in the stator 12.

In any case, it is ensured through the shown support of the rotor 16 with respect to the stator 12 that the drives 8-10 can taper towards the guide bars 1-3 such that several drives 8-10 can also easily be arranged next to one another so that the guides 4-6 can almost meet at one point.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A guide bar drive in a knitting machine comprising:

a linear motor composed of a stator and a rotor, said linear motor being greater in height than width;

said stator having a length in a longitudinal direction and including at least one narrow side;

said rotor being structured and arranged in said stator for translational movement in the longitudinal direction; and a guide rod positioned adjacent said at least one narrow side and extending in the longitudinal direction to support said rotor, wherein said rotor is coupled to said guide rod and said guide rod is displaceable with respect to said stator.

2. The guide bar drive in accordance with claim 1, wherein said stator includes end faces, and said drive further comprises flanges arranged at both end faces of said stator to support said guide rod.

3. The guide bar drive in accordance with claim 2, wherein said flanges project beyond said at least one narrow side.

4. The guide bar drive in accordance with claim 1, wherein said guide rod is supported in a rotationally fixed manner and said rotor comprises a stabilizer coupled to said guide rod.

5. The guide bar drive in accordance with claim 1, further comprising a guide bar connection coupled to said rotor on a side of said guide rod opposite said stator.

6. The guide bar drive in accordance with claim 5, wherein said guide bar connection comprises a push rod and a tension cable tightenable by a spring, and wherein an outer diameter of said spring is at most as large as an outer diameter of said guide rod.

7. The guide bar drive in accordance with claim 6, wherein said push rod has a larger spacing from said guide rod than said tension cable.

8. The guide bar drive in accordance with claim 1, further comprising a connection carrier structured and arranged to support said rotor on said guide rod.

9. The guide bar drive in accordance with claim 8, wherein said connection carrier comprises at least one cooling fin and is attached to said rotor in a heat-conducting manner.

10. The guide bar drive in accordance with claim 1, wherein said guide rod comprises a hollow space running in the longitudinal direction.

11. The guide bar drive in accordance with claim 10, wherein said hollow space is connected to a coolant source.

12. The guide bar drive in accordance with claim 1, further comprising a lateral sliding guide arrangement between said rotor and said stator arranged at an end of said stator opposite said at least one narrow end.

13. The guide bar drive in accordance with claim 1, wherein said rotor is formed as an iron-free rotor.

14. The guide bar drive in accordance with claim 1, wherein at least one of said stator and said rotor is equipped with permanent magnets.

15. A method of driving a guide bar in a knitting machine with a guide bar drive in accordance with claim 1, the method comprising:

coupling the guide bar to the rotor of the linear motor; and translationally moving the rotor in a longitudinal direction of the stator having at least one narrow side, while the coil is supported adjacent the at least one narrow side.

16. The method in accordance with claim 15, wherein the guide bar is coupled to the moving rotor by at least a push rod and a tension cable tightenable by a spring.

17. The guide bar drive in accordance with claim 1, further comprising:

a support element coupled to support said moving coil adjacent said narrow side.

18. The guide bar drive in accordance with claim 17, wherein the guide bar is coupled to the support element.

19. The guide bar drive in accordance with claim 17, wherein said support element tapers from said narrow side in a direction away from said stator.

* * * * *

UNITED STATES PATENT AND TRADEMARK OFFICE

CERTIFICATE OF CORRECTION

PATENT NO. : 7,332,836 B2
APPLICATION NO. : 11/115316
DATED : February 19, 2008
INVENTOR(S) : Mista It is certified that error appears in the above-identified patent and that said Letters Patent is hereby corrected as shown below:

At Title page, column 1, line 4 item (73) (Assignee) of the printed patent "Karl Mayer Testilmaschinenfabrik GmbH" should be -- Karl Mayer Textilmaschinenfabrik GmbH --.

Signed and Sealed this

Ninth Day of February, 2010

David J. Kappos

David J. Kappos
*Director of the United States Patent and Trademark Office*